US008382508B1

(12) United States Patent
Frey et al.

(10) Patent No.: US 8,382,508 B1
(45) Date of Patent: Feb. 26, 2013

(54) HIGH VOLTAGE MECHANICAL SPLICE CONNECTOR

(75) Inventors: Jeffrey G. Frey, Broken Arrow, OK (US); Donald Ray Lingenfelter, Claremore, OK (US); Terry L. Glasscock, Vinita, OK (US); Steven K. Tetzlaff, Owasso, OK (US); Chad A. Craig, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 23 days.

(21) Appl. No.: 13/222,978

(22) Filed: Aug. 31, 2011

(51) Int. Cl.
*H01R 13/58* (2006.01)

(52) U.S. Cl. ..... 439/461; 174/84 R

(58) Field of Classification Search ..... 439/461, 439/462, 589, 597, 191, 274–277, 465; 174/53 G, 174/84 R
See application file for complete search history.

(56) References Cited

U.S. PATENT DOCUMENTS

| | | | | |
|---|---|---|---|---|
| 3,187,088 | A | 6/1965 | Warner | |
| 3,851,296 | A | 11/1974 | Muchmore et al. | |
| 4,073,559 | A * | 2/1978 | Lawson, Jr. | 439/276 |
| 4,241,004 | A * | 12/1980 | Hervig | 264/262 |
| 4,610,737 | A | 9/1986 | Bacon et al. | |
| 4,614,392 | A | 9/1986 | Moore | |
| 4,728,296 | A * | 3/1988 | Stamm | 439/275 |
| 6,250,960 | B1 * | 6/2001 | Youtsey | 439/578 |
| 6,321,021 | B1 * | 11/2001 | Cairns et al. | 385/138 |
| 6,361,342 | B1 * | 3/2002 | Cox | 439/275 |
| 7,029,327 | B2 * | 4/2006 | Devine | 439/587 |
| 7,208,855 | B1 * | 4/2007 | Floyd | 310/71 |
| 2010/0065302 | A1 | 3/2010 | Nesbitt | |

* cited by examiner

*Primary Examiner* — Edwin A. Leon
*Assistant Examiner* — Harshad Patel
(74) *Attorney, Agent, or Firm* — Bracewell & Giuliani LLP

(57) ABSTRACT

An electrical power assembly comprises a motor lead with individual metal sheathed conductors, a power cable with individual metal sheathed conductors and a splice connector for connecting each of the conductors. Each splice connector has a tubular metal fastener body with an upward facing shoulder at an upper end and a downward facing shoulder at a lower end. A metal nut assembly is fixed to one of the power cable conductors with a downward facing shoulder in metal-to-metal sealing engagement with the upward facing shoulder of the fastener body. A metal coupler fixed to one of the motor lead conductors with an upward facing shoulder in metal-to-metal sealing engagement with the downward facing shoulder of the fastener body. Contacts electrically connect one of the motor lead conductors to one of the power cable conductors within the fastener body. An elastomeric seal disposed between the nut assembly and the fastener body, has expansion relief voids operable to collapse and relieve stresses exerted by the seal when the seal undergoes thermal expansion.

14 Claims, 5 Drawing Sheets

HIGH VOLTAGE MECHANICAL SPLICE CONNECTOR

FIELD OF THE INVENTION

This invention relates in general to electrical submersible pump assemblies for subterranean well production, in particular, to a connector for connecting a power cable to a motor lead of the pump assembly.

BACKGROUND OF THE INVENTION

Submersible pumping systems are often used in hydrocarbon producing wells for pumping fluids from within the well bore to the surface. These fluids are generally liquids and include produced liquid hydrocarbon as well as water. One type of system used in this application employs a electrical submersible pumping system (ESP). A common type of ESP comprises a centrifugal pump suspended on a string of tubing within a casing of the well. The pump is driven by a downhole electrical motor, normally a three-phase AC type. A power line extends from a power source at the surface alongside the tubing to the motor to supply power.

Typically the power line is made up of two sections, a motor lead and a power cable. The motor lead has a plug on its lower end that secures to a receptacle known as a "pothead" at the upper end of the electrical motor. The other end of the motor lead is connected to a power cable with a splice, or other type of connector.

In some wells, the well environment may be quite harsh with high temperatures and pressures and corrosive well fluids. However, current splicing media or materials used in the existing art may not be capable of withstanding the harsh environments in some wells. If these materials degrade, well fluids could enter the connection and a short could result that would require the pump assembly to be pulled and replaced. For these same reasons, it would be desirable for a connection to have minimal elastomeric, epoxy and potable materials.

In addition, the high temperature of the well will cause the components of the connector to expand. This expansion may damage the connector and the connection by creating sufficient forces to the components of the splice connection to deform and damage them. A connector splice that can withstand the thermal expansion forces resulting from a high temperature environment would be desirable.

Current art connectors may require that the connection be made in a shop environment and once the connection is made, it could not be disconnected or reconnected. It would be desirable for a connector to have the capability to be connected on site and to allow a connector to be disconnected and reconnected at the site, as needed or desired.

Conventional connection designs may be bulky and have large profiles. However, there are some situations in which the target wells have size limitations that prevent the use of these conventional designs. Therefore, it would be beneficial to have a connector design that is operable to work in harsh conditions and overcome the other shortcomings discussed above while maintaining a small profile.

SUMMARY

Embodiments of this application include devices that couple multi phase high voltage power cable to individual tube encapsulated, high voltage motor lead cables. The philosophy behind the device is that it can connect multi phase cable conductors multiple times, in a low profile manner that eliminates phase to phase shorts, along with providing multiple sealing barriers between the well annulus and connection.

The device can be manufactured in a controlled environment and factory acceptance tested before field installation, allowing for a superior field connection. The multi phase power cable will be prepped with individual connectors for each phase. Then a series of factory acceptance testing, both mechanical and electrical, will be performed to ensure integrity. Likewise, the tube encapsulate motor lead will be prepped with individual connectors. Then a series of factory acceptance testing, both mechanical and electrical will be performed to ensure integrity. Once the equipment has arrived in the field, both components can be connected quickly, elevating the use of a splice.

In one embodiment of the current application, an electrical power assembly for supplying power to a motor has a motor lead having one end for connection to the motor and having a plurality of individual metal sheathed conductors, a power cable having one end for connection to a power source and having a plurality of individual metal sheathed conductors, and a splice connector for joining each of the conductors of the motor lead to one of the conductors of the power cable. The splice connector includes a tubular metal fastener body with a motor lead end and a power cable end, a tapered motor lead shoulder adjacent to the motor lead end and a tapered power cable shoulder adjacent to the power cable end. There may be fastener body threads on the power cable end and on the motor lead end of the fastener body. The splice connector also has a metal nut assembly fixed to one of the power cable conductors having threads that engage the fastener body threads on the power cable end, the metal nut assembly having a tapered shoulder in metal-to-metal sealing engagement with the power cable shoulder of the fastener body. A metal coupler is fixed to one of the motor lead conductors and has threads that engage the fastener body threads on the motor lead end. The metal coupler has a tapered shoulder in metal-to-metal sealing engagement with the motor lead shoulder of the fastener body, thereby sealing an interior of the fastener body. An electrical contact on the conductor of the power cable and the conductor of the motor lead mate with each other in the interior of the fastener body.

In some embodiments, the assembly includes an elastomeric seal disposed between the nut assembly and the fastener body, the elastomeric seal having a plurality of expansion relief voids operable to collapse and relieve stresses exerted by the seal when the seal undergoes thermal expansion. The elastomeric seal may be located within the interior of the fastener body axially between the tapered shoulders. The elastomeric seal may have a conical shoulder that engages a conical shoulder of the fastener body and a flat shoulder facing the nut assembly and wherein the relief voids extend into the flat shoulder.

In other embodiments, the assembly may include an access port through a wall of the fastener body and a closure member for opening and closing the access port. The fastener body may be filled with a dielectric fluid which is pumped through the access port when the access port is open.

In other embodiments, the assembly may include a plurality of the splice connectors, each independently connecting one motor lead conductor to one power cable conductor. The threads at the power cable end and the motor lead end may be internal. The tapered shoulders adjacent the power cable end and the motor lead end may be within the interior of the fastener body.

In alternative embodiments, an electrical power assembly for supplying power to a motor includes a motor lead having one end for connection to the motor and having a plurality of individual conductors, a power cable having one end for connection to a power source and having a plurality of individual conductors and a splice connector for joining each of the conductors of the motor lead to one of the conductors of the power cable. The splice connector may include a tubular metal fastener body with a motor lead end and a power cable end and fastener body threads on the power cable end and on the motor lead end of the fastener body. The splice connector may also include a metal nut assembly fixed to one of the power cable conductors having threads that engage the fastener body threads on the power cable end. An electrical contact on the conductor of the power cable and the conductor of the motor lead, may mate with each other in the interior of the fastener body. An elastomeric seal may be disposed between the nut assembly and the fastener body, the elastomeric seal including a plurality of expansion relief ports operable to collapse and relieve stresses exerted by the seal when the seal undergoes thermal expansion.

In some embodiments, the elastomeric seal comprises a flat end face, a cylindrical band adjacent to the end face, and a tapered conical portion opposite the end face. The relief ports may be open to the end face and are shorter in length than a length of the cylindrical band. An outside surface of the tapered conical portion may mate with a tapered shoulder of the fastener body.

In yet other embodiments, an electric submersible pumping system includes a pump, an electric motor coupled to the pump, a motor lead connected to the motor and having a plurality of motor lead conductors, a power cable having a plurality of power cable conductors and a splice connector for connecting each of the power cable conductors to one of the motor lead conductors. Each of the splice connectors may include a tubular metal fastener body with a motor lead end and a power cable end and a tapered motor lead shoulder in the interior of the fastener body adjacent to the motor lead end and a tapered power cable shoulder in the interior of the fastener body adjacent to the power cable end. There may be fastener body threads on the power cable end and on the motor lead end of the fastener body. Each of the splice connectors may also include a metal nut assembly having threads that engage the fastener body threads on the power cable end, the metal nut assembly having a tapered shoulder in metal-to-metal sealing engagement with the power cable shoulder of the fastener body. A metal coupler may have threads that engage the fastener body threads on the motor lead end. The metal coupler may also have a tapered shoulder in metal-to-metal sealing engagement with the motor lead shoulder of the fastener body, thereby sealing an interior of the fastener body. An electrical contact on the conductor of the power cable and the conductor of the motor lead, may mate with each other in the interior of the fastener body.

In yet other embodiments, an electrical power assembly for supplying power to a motor includes a motor lead for connection to the motor and having a plurality of individual metal sheathed conductors, a power cable for connection to a power source and having a plurality of individual metal sheathed conductors and a tubular fastener body. The fastener body may include contacts for electrically connecting the one of the motor lead conductors to the one of the power cable conductors within the interior of the fastener body, and seals at a motor end and a power cable end of the fastener body for sealing of the one of the motor lead conductors and one of the power cable conductors to the fastener body, the seals defining a sealed interior within the fastener body containing a dielectric fluid. An access port through a wall of the fastener body may be operable to allow dielectric fluids to enter therethrough into the interior of the fastener body and there may be a closure member for opening and closing the access port. The closure member may be a screw.

In other embodiments, a mechanical connector includes a tubular metal fastener body with a first end and a second end and a tapered first shoulder adjacent to the first end and a tapered second shoulder adjacent to the second end and fastener body threads on the first end and on the second end of the fastener body. A metal nut assembly may be operable to connect to a conductor of a first cable, the nut assembly having threads that engage the fastener body threads on first end. The metal nut assembly may have a tapered shoulder in metal-to-metal sealing engagement with the first shoulder of the fastener body. A metal coupler may be operable to connect to a conductor of a second cable, the coupler having threads that engage the fastener body threads on the second end. The metal coupler may have a tapered shoulder in metal-to-metal sealing engagement with the second shoulder of the fastener body, thereby sealing an interior of the fastener body. An electrical contact on the first conductor of the first cable and the conductor of the second cable, may mate with each other in the interior of the fastener body.

In some embodiments, the connector may have an elastomeric seal disposed between the nut assembly and the fastener body. The elastomeric seal may have a flat end face, a cylindrical band adjacent to the end face, a tapered conical portion opposite the end face, and a plurality of expansion relief ports operable to collapse and relieve stresses exerted by the seal when the seal undergoes thermal expansion. The relief ports may be open to the end face and are shorter in length than a length of the cylindrical band. The connector may have an access port through a wall of the fastener body and a closure member for opening and closing the access port. The interior of the fastener body may filled with a dielectric fluid which may be pumped through the access port when the access port is open.

BRIEF DESCRIPTION OF THE DRAWINGS

Some of the features and benefits of the present invention having been stated, others will become apparent as the description proceeds when taken in conjunction with the accompanying drawings, in which.

DETAILED DESCRIPTION OF THE DISCLOSURE

Figure 1:
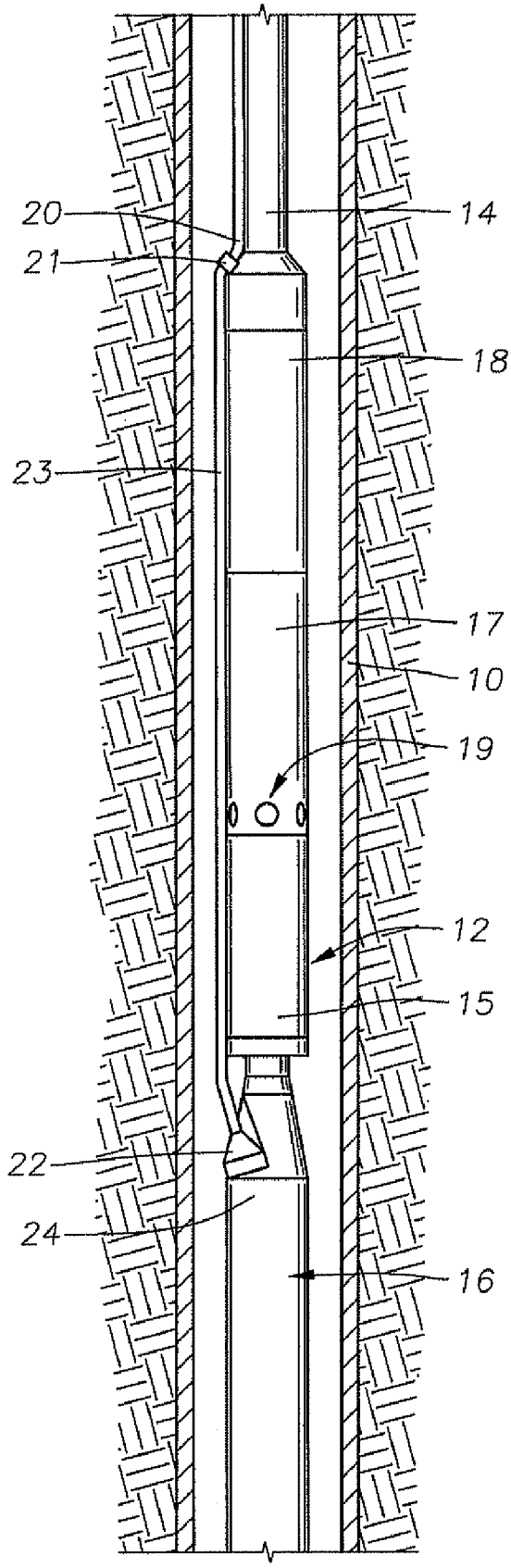
FIG. 1 is a side view of an electrical submersible pump (ESP) system within a well and having features in accordance with this disclosure.

FIG. 1 is an elevational section view of cased well 10 having an ESP 12 disposed therein. ESP 12 includes an electric motor 16, a seal/equalizer section 15, an optional gas separator 17, and a pump 18. Pump 18 may comprise a centrifugal pump, a progressing cavity pump, or some other rotary pump. Fluid inlets 19 are shown provided on separator 17 for providing a passage for receiving fluid into pump 18. Production tubing 14 is coupled to pump 18 discharge for conveying pressurized production fluid from the ESP 12 to surface.

In this embodiment, power cable 20 extends alongside production tubing 14, terminating in a splice or connector 21 that electrically couples cable 20 to a second power cable, or motor lead 23. Power cable 20 may be a high voltage, multi phase power cable, such as a three phase power cable. On the lower end of power cable 20, motor lead 23 connects to a pothead connector 22 that electrically connects and secures motor lead 23 to motor housing 24 of electric motor 16. The motor lead 23 extends upward beyond the pump, for example from 10 to 80 ft. The motor lead 23 could exceed 80 ft or be shorter than 10 ft depending on the application. The motor lead 23 may be flat and smaller in dimension than the power cable so that it can pass between the pump assembly and the casing.

Figure 2:
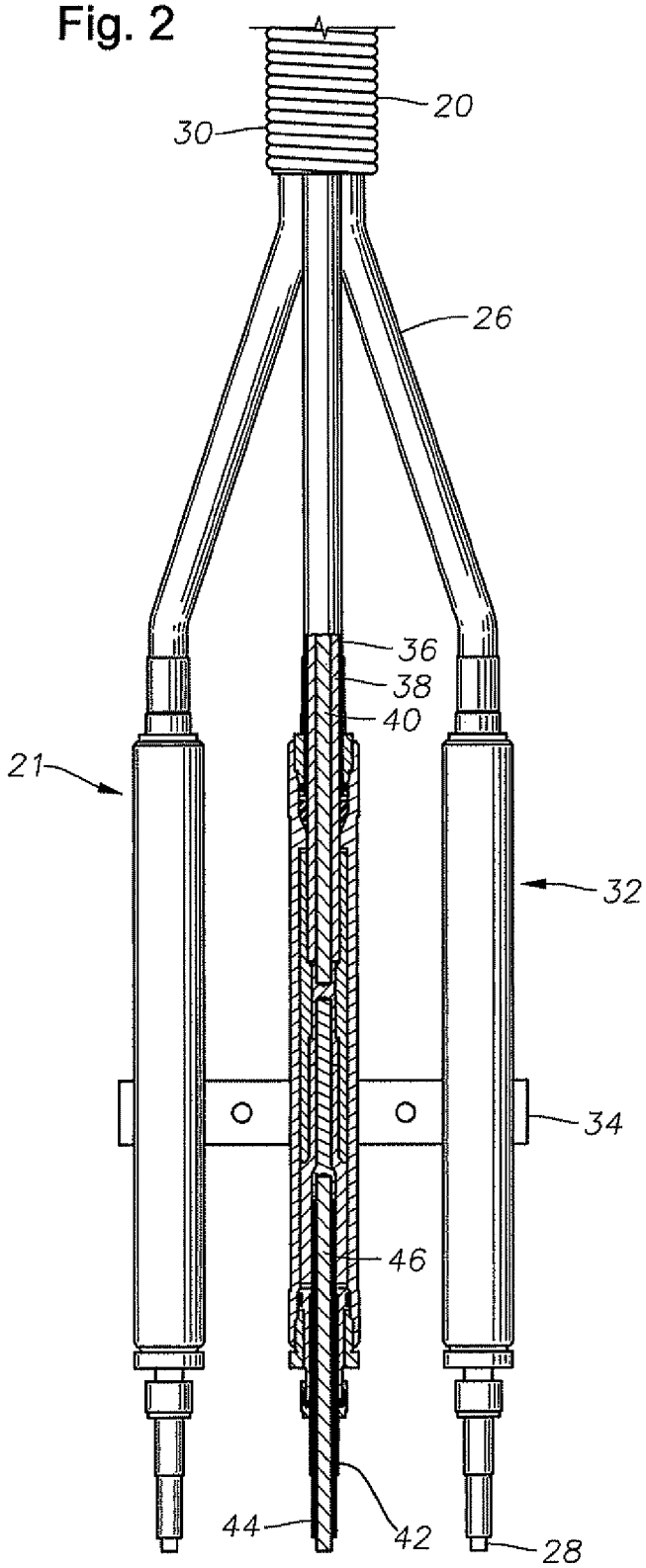
FIG. 2 is a partial sectional view of a connector having features in accordance with this disclosure.

Turning to FIG. 2, connector 21 connects the phase conductor 26 of the power cable 20 to phase conductor 28 of the motor lead 23 (FIG. 1). A metallic armor 30 is typically wrapped around the outside of the power cable 20 to form the exterior of the power cable. A bracket may be used to secure the armor 30 to the power cable 20. Alternatively, it may be soldered in place. The power cable 20 has 3 separate phase conductors 26 and each conductor 26 is coupled to a individual splice connector 32. A shipping bracket 34 may be used to secure each splice connector 32 at a selected distance from each other while the power cable 20 is being shipped from the fabrication facility to the field location.

Each phase conductor 26 of power cable 20 comprises an outer metal tubing sheath 36 as its outermost layer. Cable tubing 36 is a tubular with a central axis and may be formed of ferrous metals including carbon steel, stainless steel tubular or non-ferrous metals, like Monel. A layer of cable insulation 38 is located within and co-axial to cable tubing 36. Cable insulation 38 forms a tubular with a central opening which contains cable wire 40. Cable wire 40 is a solid cylindrical member which is co-axial with both cable insulation 38 and cable tubing 36. In alternative embodiment, cable wire 40 could be a series of smaller braided wires to comprise a single wire member or phase.

Each conductor 28 of the motor lead 23 (FIG. 1) similarly comprises an outer metal tubing sheath 42 as its outermost layer. Lead tubing sheath 42 is a tubular member with a central axis and may be formed of carbon steel, or stainless steel tubular. A layer of lead insulation 44 is located within and co-axial to lead tubing 42. Lead insulation 44 forms a tubular with a central opening which contains lead wire 46. Lead wire 46 is a solid cylindrical member which is co-axial with both lead insulation 44 and lead tubing 42.

In the embodiment shown in FIG. 2, the three splice connectors 32 are located at the same distance from the termination of armor 30 of the power cable 20. In alternative embodiments, the splice connectors 32 may each be located at a different distance from the end of armor 30 of the power cable 20. In such an embodiment, the vertical elevation of each splice connector 32 when situated in a cased well 10 would be different and the overall diameter of the connector 21 would be smaller, allowing for a more streamlined connection for use in a smaller diameter well or to increase the clearance between the connector 21 and the wall of the cased well 10.

Figure 3A:
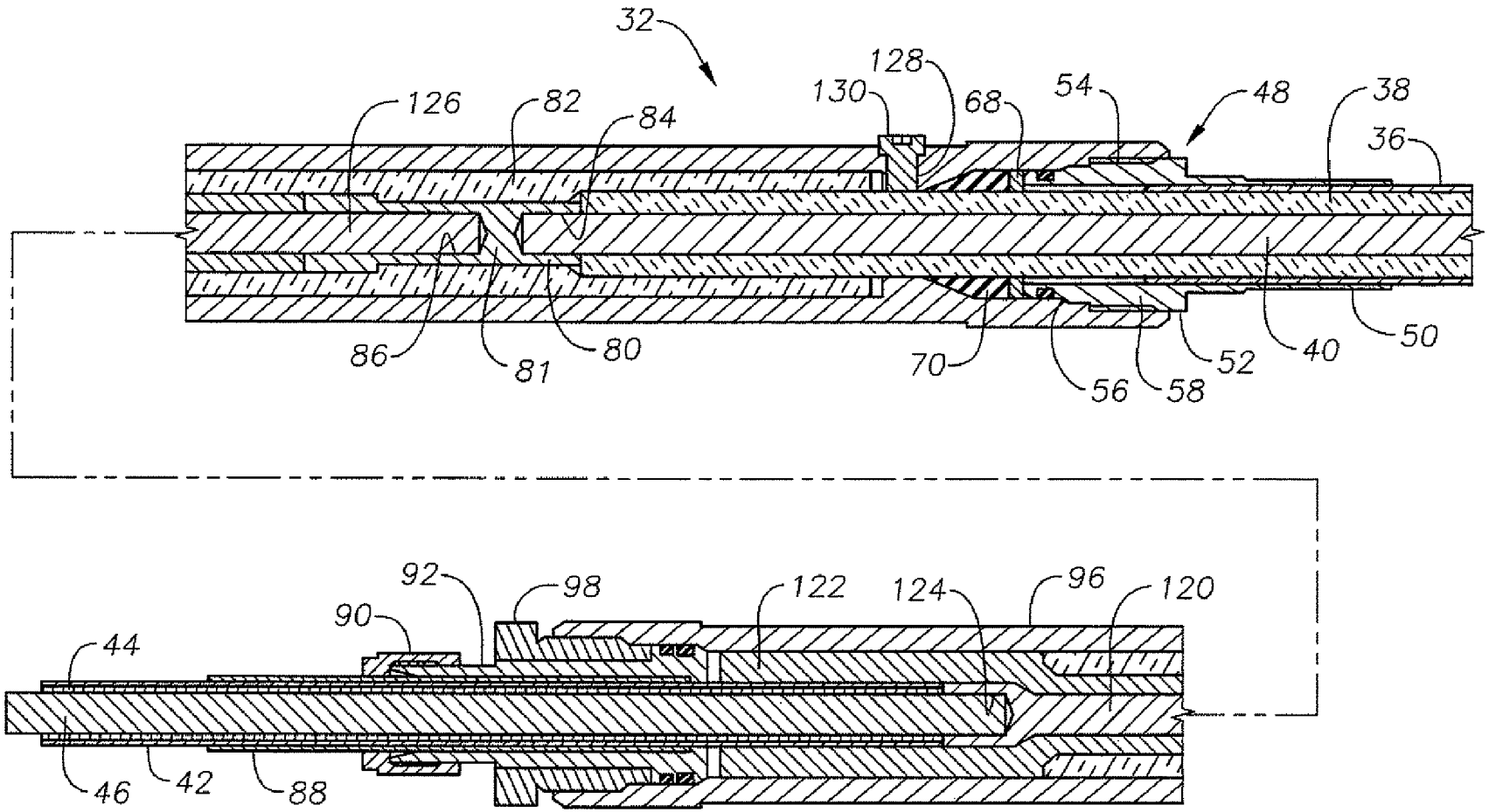
FIG. 3A is a sectional view of a portion of the connector of FIG. 2.

Turning to FIG. 3A, in its assembled state, splice connector 32 allows for the completion of an electrical connection between cable wire 40 and lead wire 46. In its assembled state, a compression nut assembly 48 is located outside of cable tubing 36 at an end of the splice connector 32 nearest to power cable 20 (FIG. 2). This end will be the upper end of the apparatus when installed in the well. Compression nut assembly 48 is a metallic tubular member with a substantially constant inner diameter and a central axis and comprises a nut profile 52 to allow for a tool to tighten and loosen the nut assembly 48. A stem 50 is located on an upper end of the nut profile 52. Stem 50 has a smaller wall thickness than nut profile 52. Stem 50 facilitates the use of a lead foil and high modulus tape to be wrapped and join the nut assembly 48 to the cable tubing 36.

Figure 3B:
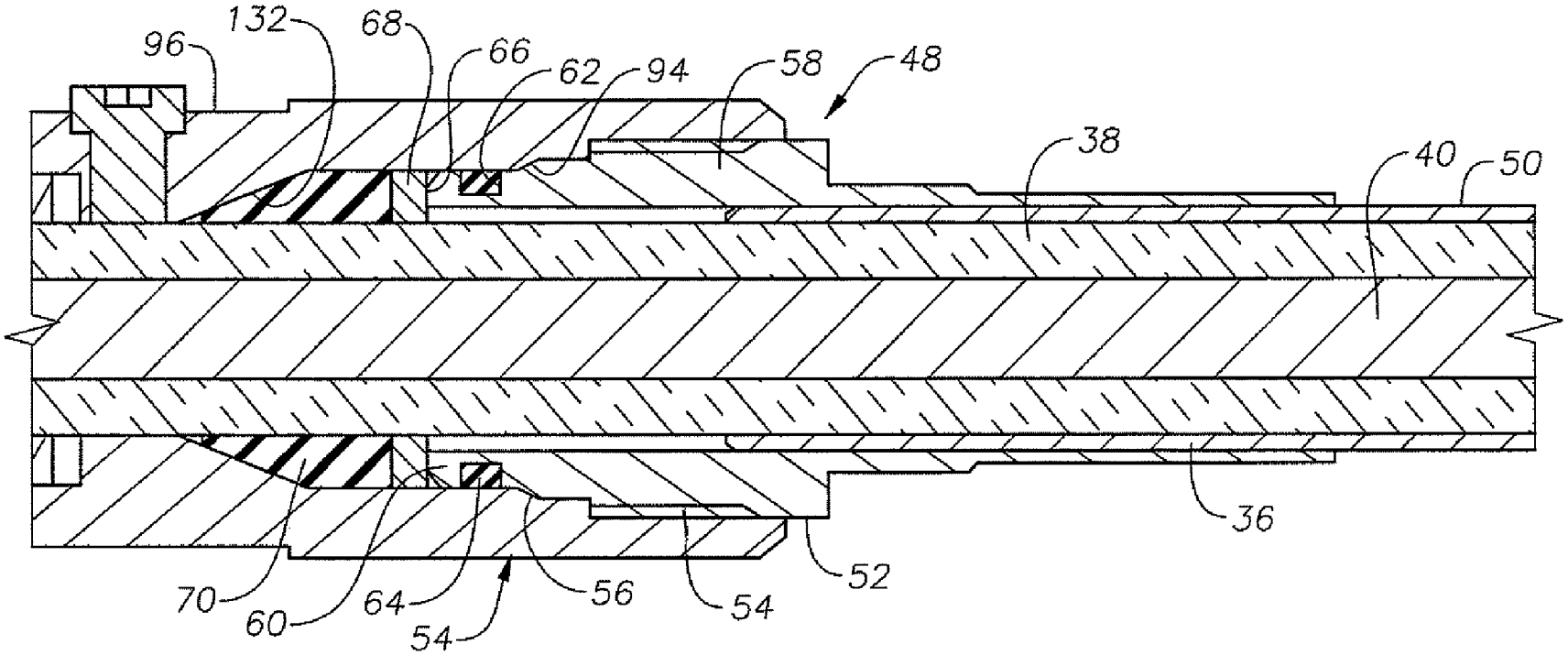
FIG. 3B is a sectional view of a portion of the connector of FIG. 3A.

As is seen in FIG. 3B, on an opposite side to stem 50 of nut profile 52, nut assembly 48 comprises a seal section 54. Seal section 54 has a wall thickness that is greater than stem 50. Seal section 54 comprises a downward facing shoulder 56 which slopes from a region of greater wall thickness 58 towards the upper end of nut assembly 48 and a region of lesser wall thickness 60 towards an lower end of nut assembly 48. Seal shoulder 56 engages an upward facing body shoulder 94 of fastener body 96. Fastener body 96 is a metallic cylindrical tube with a central axis co-axial to the central axis of the cable wire 40. The engagement of seal shoulder 56 with body shoulder 94 creates a metal-to-metal seal between nut assembly 48 and fastener body 96. Gas decompression is one of the leading causes of failure of ESP components. This metal-to-metal seal prevents gas migration into the fastener body 96. Furthermore, the presence of sour gas, H2S, is extremely detrimental to copper conduits and other materials. This metal-to-metal seal will provide a long term solution to both of these concerns.

A circumferential recess 62 is formed within the region of lesser wall thickness 60 of nut assembly 48. An elastomeric seal ring 64 is located within recess 62. Seal ring 64 creates a back-up seal between nut assembly 48 and fastener body 96. Threads on an exterior surface of nut assembly 48 may engage threads on an internal surface of the upper end of fastener body 96 to retain nut assembly 48 within fastener body 96. In alternative embodiments, other known forms of connection may be used to retain nut assembly 48 within fastener body 96. Cable tubing 36 terminates within nut assembly 48, while cable insulation 38 and cable wire 40 extend through the entire length of nut assembly 48.

Figure 4A:
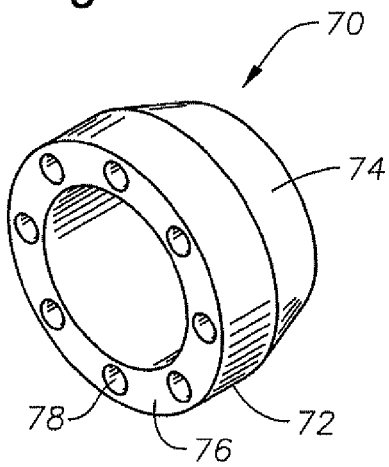
FIG. 4A is an enlarged perspective view of a seal of the connector of FIG. 2.
Figure 4B:
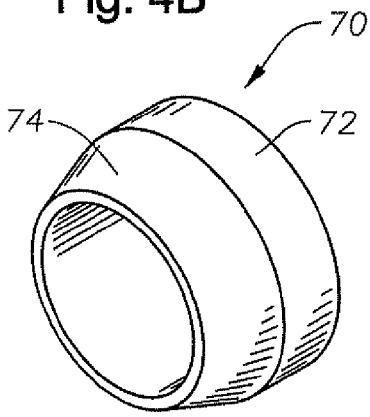
FIG. 4B is another enlarged perspective view of a seal of the connector of FIG. 2.

Abutting the lower end 66 of nut assembly 48 is a first side of a metal thrust washer 68. Thrust washer 68 protects an elastomeric main seal 70 from rotational motion of nut assembly 48 and transfers the axial forces of nut assembly 48 Cable insulation 38 and cable wire 40 extend through the internal bore of main seal 70. As can be seen in FIGS. 4A and 4B, main seal 70 comprises a cylindrical band 72 and a tapered conical portion 74. An end face 76 of main seal 70 abuts the second of side thrust washer 68. The outer surface of tapered conical portion 74 of main seal 70 engages a second upward facing shoulder 132 (FIG. 3B) of fastener body 96. Main seal 70 may be formed of an elastomeric or other suitable material.

A number of expansion relief voids 78 are located within the cylindrical band 72. The voids 78 are open to end face 76 and are shorter in length than the length of cylindrical band 72. When exposed to high temperatures, main seal 70 will tend to expand. When the main seal 70 tends to expand it deforms against thrust washer 68 and upward facing shoulder 132, causing the material of main seal 70 to extend into or collapse into voids 78. This will reduce both the axial and the outward forces that main seal 70 would otherwise apply to the components that are in proximity to main seal 70. This will allow the nut assembly 48 to be used successfully in a broader range of high temperature well conditions.

Returning to FIG. 3A, cable wire 40 terminates within a bore of a female terminal pin or receptacle 80. Female pin 80 is a tubular member with a central axis co-linear to the axis of the cable wire 40. Female pin 80 has a bulkhead 81 which separates the cable wire pocket 84 from the pin pocket 86. Cable insulation 38 terminates at or before the upper end of female pin 80 so that cable wire 40 is bare within female terminal pin 80 and can be crimped within cable wire pocket 84. Surrounding the female pin 80 and the cable insulation 38 is a receptacle or female insulator 82. Female insulator 82 may be attached to female pin 80 with a circular clip or other known retaining means. Female insulator 82 has varying wall thicknesses to accommodate the different outer diameters of the female pin 80 and the cable insulation 38. Female insulator 82 is inside of fastener body 96 and creates an electrically insulating barrier between female pin 80 and fastener body 96. Female insulator may be formed of, for example, a high temperature polymer, thermoplastic or other known appropriate insulating material.

Turning now to the end of splice connector 32 closest to motor lead 23 (FIG. 1), a hollow tubular lead stem 88 is located around the lead tubing 42 of the lead conductor 28 (FIG. 2). This end will be the lower end of the apparatus when installed in the well. Lead stem 88 facilitates the use of a lead foil and high modulus tape to be wrapped and join the lead stem 88 to the lead tubing 42. A compression fitting, such as a Swagelok type mechanical seal joint 90 is located around the lead stem 88. In alternative embodiments, lead stem 88 may not be used and compression fitting 90 may instead be located directly around lead tubing 42. When tightened, compression fitting 90 will grip either lead stem 88 or lead tubing 42, as applicable. Interior threads on compression fitting 90 engage external threads on housing coupler 92. Housing coupler 92 is located around lead stem 88. A metallic coupler nut assembly 98 is located outside of housing coupler 92.

Figure 3C:
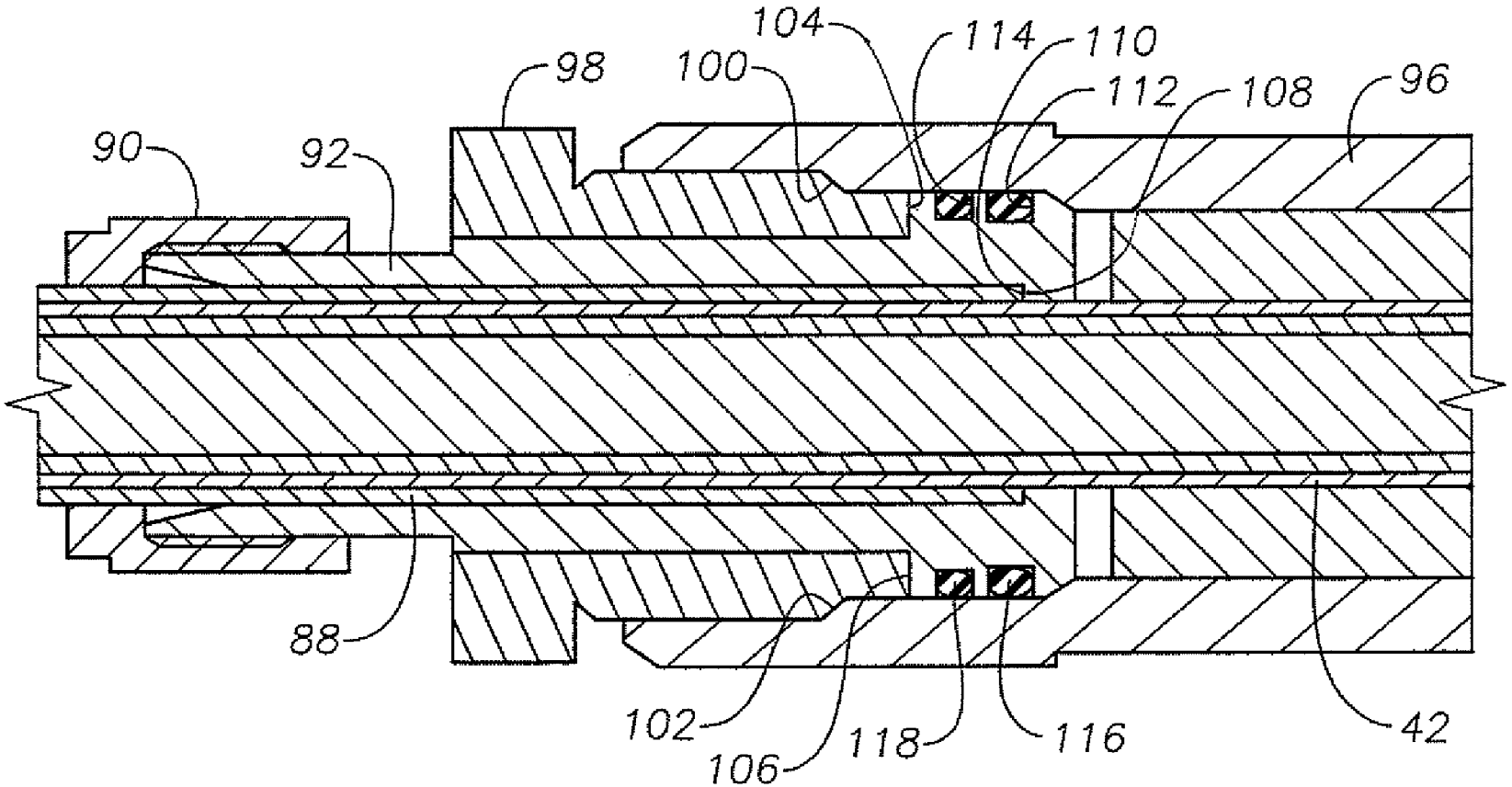
FIG. 3C is a sectional view of a portion of the connector of FIG. 3A.

As can be seen in FIG. 3C, an upward facing coupler shoulder 100 of coupler nut 98 engages a downward facing body shoulder 102 of the lower end of fastener body 96. The engagement of coupler shoulder 100 and body shoulder 102 creates a metal-to-metal seal between the coupler nut 98 and the fastener body 92. This metal-to-metal seal prevents gas migration into the fastener body 96. An upper end 104 of coupler nut 98 engages a downward facing shoulder 106 of housing coupler 92, and an upper end 108 of lead stem 88 engages an inner downward facing shoulder 110 of housing coupler 92.

Threads on an exterior surface of coupler nut 98 may engage threads on an internal surface of the lower end of fastener body 96 to retain coupler nut 98 within fastener body 96. In alternative embodiments, other known forms of connection may be used to retain coupler nut 98 within fastener body 96. Housing coupler 92 comprises at least one, and as shown in FIG. 3C, may include two annular recesses 112, 114. Annular recess 112 houses a back-up seal 116 and annular recess 114 houses a second back-up seal 118. Each back-up seal 116, 118 may be, for example, an elastomeric o-ring or other standard sealing means. Each back-up seal 116, 118 sealingly engages an inside wall of fastener body 96 and creates a seal between the housing coupler 92 and the fastener body 96.

Returning to FIG. 3A, lead wire 46 terminates within a bore of a male terminal pin 120. Male pin 120 comprises a wire pocket 124 at its lower end into which the lead wire 46 is located and crimped. The upper end of male pin 120 is a cylindrical pin member 126 with a central axis co-linear to the axis of the lead wire 46. Lead insulation 44 terminates at or before the lower end of wire pocket 124 so that cable wire 40 is bare within wire pocket 124.

Surrounding the male pin 120, and the lead insulation 44 is a pin or male insulator 122. Male insulator 122 is inside of fastener body 96 and creates an electrically insulating barrier between male pin 120 and fastener body 96. Male insulator may be formed of, for example, a high temperature polymer, thermoplastic or other known appropriate insulating material. Male insulator 122 may be attached to male pin 120 with a circular clip or other known retaining means. Male insulator 122 is a tubular member with a larger outer diameter and larger inner diameter at a lower end to accommodate the lead wire 46, lead insulation 44 and wire pocket 124. At its upper end, male insulator 122 has a smaller inner diameter surrounding the pin member 126 and a smaller outer diameter to fit within a lower end of female insulator 82. Male insulator 122 terminates before an upper end of pin member 126 such that pin member 126 may be disposed directly into wire pocket 84 of female pin 80. An electrical connection between the cable wire 40 and the lead wire 46 is made by way of the cable wire 40 being connected to the female pin 80, which is in contact with the male pin 120, which in turn is connected to the lead wire 46.

Fastener body 96 extends from the nut assembly 48 at its upper end, to coupler nut 98 at its lower end. As discussed above, there are metal-to-metal seals at both the upper end and lower end of fastener body 96. In some embodiments, air that is trapped within the confines of fastener body 96 may be vacuumed out by way of an access port 128 through the fastener body. To do so, a screw 130 in port 128 could be removed from the fastener body to open port 128. A dielectric fluid, such as dielectric motor oil, dielectric grease, or other suitable substance, may be pumped through port 128 to displace any air and fill any voids within fastener body 96. Screw 130 would then be replaced back in port 128 to close and seal port 128.

In operation, each phase conductor 26 the power cable 20 will be prepared and fitted with certain components of an individual splice connector 32. Likewise, each phase conductor 28 of the motor lead 23 will be prepared and fitted with certain components of an individual splice connector 32. Before and after the mating of the components of each splice connector 32, a series of factory acceptance tests, both mechanical and electrical may then be performed to ensure integrity of each splice connector 32. The splice connector 32 may then be disconnected and the motor lead 23 and power cable 20 relocated to its field of service. Once the motor lead 23, power cable 20 and related equipment has arrived in the field, the components of each splice connector 32 can be quickly and easily reconnected before the ESP assembly is lowered into the well by traditional means. Because each phase conductor 26 of power cable 20 mates independently by a separate splice connector 32 to each phase conductor 28 of the motor lead 23, the possibility of phase to phase shorts will be significantly reduced.

In addition, if the ESP needs to be returned to the surface for service or repair, the components of each splice connector 32 can be easily disconnected from each other, allowing the power cable 20 to be separated from the motor lead 23. When the ESP is ready to be returned to the well, the components of splice connector 32 can be easily reconnected to each other, creating an electrical connection between the power cable 20 and the motor lead 23.

During a disconnection procedure, looking at FIG. 3A, the compression nut assembly 48, seal ring 64, main seal 70, fastener body 96, female pin 80, and female insulator 82 will remain attached to the cable wire 40 of power cable 20. The compression fitting 90, coupler nut 98, coupler 92, male pin 120 and male insulator 122 will remain attached to the lead wire 46 of motor lead 23. In order to reconnect the components of each splice connector 32, the male pin 120, which is retained on the lead wire 46 of the motor lead 23, would be inserted into the female pin 80, which is retained on the cable conductor of power cable 20. Coupler nut 98, which is part of the motor lead 23, will engage the fastener body 96, which is part of the power cable, and either be screwed in place or otherwise made up with the applicable retention means of the particular embodiment. When coupler nut 98 is tightened, the lower metal-to-metal seal of coupler shoulder 100 to body shoulder 102 (FIG. 3C) is energized. In alternative embodiments, the fastener body 96 may instead be retained with the lead wire 46 of motor lead 23, in which case compression nut assembly 48, which is part of the power cable, would engage the fastener body 96, which is part of the motor lead 23, and be screwed in place or otherwise made up with the applicable retention means of the particular embodiment.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

What is claimed is:

1. An electrical power assembly for supplying power to a motor comprising:

a motor lead having one end for connection to the motor and having a plurality of individual metal sheathed conductors;

a power cable having one end for connection to a power source and having a plurality of individual metal sheathed conductors; and a splice connector for joining each of the conductors of the motor lead to one of the conductors of the power cable comprising:

a tubular metal fastener body with a motor lead end and a power cable end and a tapered motor lead shoulder adjacent to the motor lead end and a tapered power cable shoulder adjacent to the power cable end and fastener body threads on the power cable end and on the motor lead end of the fastener body;

a metal nut assembly fixed to one of the power cable conductors having threads that engage the fastener body threads on the power cable end, the metal nut assembly having a tapered shoulder in metal-to-metal sealing engagement with the power cable shoulder of the fastener body;

a metal coupler fixed to one of the motor lead conductors and having threads that engage the fastener body threads on the motor lead end, the metal coupler having a tapered shoulder in metal-to-metal sealing engagement with the motor lead shoulder of the fastener body, thereby sealing an interior of the fastener body; and an electrical contact on the conductor of the power cable and the conductor of the motor lead, the electrical contacts mating with each other in the interior of the fastener body; and an elastomeric seal disposed between the nut assembly and the fastener body, the elastomeric seal comprising a plurality of expansion relief voids operable to collapse and relieve stresses exerted by the seal when the seal undergoes thermal expansion.

2. The assembly of claim 1, wherein the elastomeric seal is located within the interior of the fastener body axially between the tapered shoulders.

3. The assembly of claim 1, wherein the elastomeric seal has a conical shoulder that engages a conical shoulder of the fastener body and a flat shoulder facing the nut assembly and wherein the relief voids extend into the flat shoulder.

4. The assembly of claim 1, further comprising an access port through a wall of the fastener body;

a closure member for opening and closing the access port; and wherein the fastener body is filled with a dielectric fluid which is pumped through the access port when the access port is open.

5. The assembly of claim 1, further comprising a plurality of the splice connectors, each independently connecting one motor lead conductor to one power cable conductor.

6. The assembly of claim 1, wherein the threads at the power cable end and the motor lead end are internal.

7. The assembly of claim 1, wherein the tapered shoulders adjacent the power cable end and the motor lead end are within the interior of the fastener body.

8. An electrical power assembly for supplying power to a motor comprising:

a motor lead having one end for connection to the motor and having a plurality of individual conductors;

a power cable having one end for connection to a power source and having a plurality of individual conductors;

a splice connector for joining each of the conductors of the motor lead to one of the conductors of the power cable comprising:

a tubular metal fastener body with a motor lead end and a power cable end and fastener body threads on the power cable end and on the motor lead end of the fastener body;

a metal nut assembly fixed to one of the power cable conductors having threads that engage the fastener body threads on the power cable end;

an electrical contact on the conductor of the power cable and the conductor of the motor lead, the electrical contacts mating with each other in the interior of the fastener body; and an elastomeric seal disposed between the nut assembly and the fastener body, the elastomeric seal comprising a plurality of expansion relief ports operable to collapse and relieve stresses exerted by the seal when the seal undergoes thermal expansion, and a tapered power cable shoulder adjacent the power cable end of the fastener body with and a tapered motor lead shoulder adjacent the motor lead end of the fastener body; a tapered shoulder on the metal nut assembly in metal-to-metal sealing engagement with the power cable shoulder of the fastener body; and a metal coupler fixed to one of the motor lead conductors and having threads that engage the fastener body threads on the motor lead end, the metal coupler having a tapered shoulder in metal-to-metal sealing engagement with the motor lead shoulder of the fastener body, thereby sealing an interior of the fastener body.

9. The assembly of claim 8, wherein:

the elastomeric seal comprises a flat end face, a cylindrical band adjacent to the end face, and a tapered conical portion opposite the end face;

the relief ports are open to the end face and are shorter in length than a length of the cylindrical band; and an outside surface of the tapered conical portion mates with a tapered shoulder of the fastener body.

10. The assembly of claim 8, wherein the fastener body is a metal tube with a central bore and further comprising:

an access port through a wall of the fastener body;

a closure member for opening and closing the access port; and wherein any voids within the central bore of the fastener body is filled with a dielectric fluid which is pumped through the access port when the access port is open.

11. An electric submersible pumping system comprising:

a pump;

an electric motor coupled to the pump;

a motor lead connected to the motor and having a plurality of motor lead conductors;

a power cable having a plurality of power cable conductors;

a splice connector for connecting each of the power cable conductors to one of the motor lead conductors, each of the splice connector comprising:

a tubular metal fastener body with a motor lead end and a power cable end and a tapered motor lead shoulder in the interior of the fastener body adjacent to the motor lead end and a tapered power cable shoulder in the interior of the fastener body adjacent to the power cable end and fastener body threads on the power cable end and on the motor lead end of the fastener body;

a metal nut assembly having threads that engage the fastener body threads on the power cable end, the metal nut assembly having a tapered shoulder in metal-to-metal sealing engagement with the power cable shoulder of the fastener body;

a metal coupler having threads that engage the fastener body threads on the motor lead end, the metal coupler having a tapered shoulder in metal-to-metal sealing engagement with the motor lead shoulder of the fastener body, thereby sealing an interior of the fastener body; and an electrical contact on the conductor of the power cable and the conductor of the motor lead, the electrical contacts mating with each other in the interior of the fastener body; and an elastomeric seal disposed between the nut assembly and the fastener body, the elastomeric seal comprising a plurality of expansion relief voids operable to collapse and relieve stresses exerted by the seal when the seal undergoes thermal expansion.

12. The system of claim 11, wherein:

the elastomeric seal comprises a flat end face, a cylindrical band adjacent to the end face, and a tapered conical portion opposite the end face;

the relief ports are open to the end face and are shorter in length than a length of the cylindrical band; and an outside surface of the tapered conical portion mates with a tapered shoulder of the fastener body.

13. An electrical power assembly for supplying power to a motor comprising:

a motor lead for connection to the motor and having a plurality of individual metal sheathed conductors;

a power cable for connection to a power source and having a plurality of individual metal sheathed conductors;

a tubular fastener body, the fastener body comprising:

contacts for electrically connecting the one of the motor lead conductors to the one of the power cable conductors within the interior of the fastener body;

seals at a motor end and a power cable end of the fastener body for sealing of the one of the motor lead conductors and one of the power cable conductors to the fastener body, the seals defining a sealed interior within the fastener body containing a dielectric fluid;

an access port through a wall of the fastener body operable to allow dielectric fluids to enter therethrough into the interior of the fastener body; and a closure member for opening and closing the access port.

14. The assembly of claim 13 wherein the closure member comprises a screw.

* * * * *

UNITED STATES PATENT AND TRADEMARK OFFICE

CERTIFICATE OF CORRECTION

PATENT NO. : 8,382,508 B1
APPLICATION NO. : 13/222978
DATED : February 26, 2013
INVENTOR(S) : Jeffrey G. Frey et al.

It is certified that error appears in the above-identified patent and that said Letters Patent is hereby corrected as shown below:

In the Specification:

Column 8, line 37, insert --of-- between “26” and “the”

In the Claims:

Claim 8, Column 10, line 49, delete “with” after “body”

Signed and Sealed this
Twenty-fourth Day of September, 2013

Teresa Stanek Rea
*Deputy Director of the United States Patent and Trademark Office*